US005403091A

United States Patent [19]

Thomas

[11] Patent Number: 5,403,091

[45] Date of Patent: Apr. 4, 1995

[54] SPINDLE FOR ROTARY MIXING DEVICE

[76] Inventor: Jerry W. Thomas, Rte. 2, Box 351, Macclenny, Fla. 32063

[21] Appl. No.: 43,805

[22] Filed: Apr. 7, 1993

[51] Int. Cl.[6] ..... B01F 7/00

[52] U.S. Cl. ..... 366/279; 366/343; 416/223 R

[58] Field of Search ..... 366/343, 320, 342, 348, 366/349, 279, 344, 605; 416/231 A, 70 R, 132 R, 69, 76, 223 R; D7/376, 377, 378, 379, 380

[56] References Cited

U.S. PATENT DOCUMENTS

| | | | |
|---|---|---|---|
| 798,570 | 8/1905 | Dalby | 366/248 |
| 1,248,153 | 11/1917 | Offenhauser | 366/342 |
| 3,328,005 | 6/1967 | McMaster et al. | 366/343 |
| 3,619,081 | 11/1971 | Gruska | D7/380 |
| 4,711,582 | 12/1987 | Kennedy | 366/279 |

FOREIGN PATENT DOCUMENTS

| | | | |
|---|---|---|---|
| 0009543 | 11/1908 | France | 416/69 |
| 1016069 | 10/1952 | France | 366/248 |
| 1075560 | 2/1960 | Germany | 366/325 |
| 2902855 | 7/1980 | Germany | 366/343 |
| 3936706 | 5/1990 | Germany | 366/279 |
| 0116788 | 10/1926 | Switzerland | 366/343 |
| 1473830 | 4/1989 | U.S.S.R. | 366/292 |
| 8706852 | 11/1987 | WIPO | 366/325 |

*Primary Examiner*—David A. Scherbel
*Assistant Examiner*—Tony G. Soohoo
*Attorney, Agent, or Firm*—Edward S. Irons

[57] ABSTRACT

A novel rotatable mixing device having two intersecting mixing elements attached to an end of a rotatable shaft. The mixing elements intersect at 90°, have a generally U-shaped base portion, liner extensions of the legs of the U-shapes, and tip elements extending linearly from the end of the legs.

4 Claims, 3 Drawing Sheets

SPINDLE FOR ROTARY MIXING DEVICE

FIELD OF THE INVENTION

This invention relates to a rotary shaft driven spindle for stirring, mixing, blending or agitating fluid media.

BACKGROUND OF THE INVENTION

Typical designs for shaft driven fluid mixers or spindles are described in U.S. Pat. Nos. 670,469, 2,905,453, 4,830,507, 4,844,355 and 5,030,011.

SUMMARY OF THE INVENTION

A novel rotary shaft driven spindle is provided by unique components assembled in particular dimensional relationships. These dimensional relationships impart to the stirred media force vectors which tend to maximize agitation and blending of the media components. Product homogeneity is rapidly achieved. The spindle is readily constructed from available materials low in cost and easily maintained.

DEFINITIONS

As used in this application the terms "spindle" and "talon" have the meaning set forth below.

Spindle—a structure for attachment to a rotary shaft to mix, agitate or blend liquid or liquid containing media when rotated therein.

Talon—an element of a spindle attached or for attachment to a rotary shaft. A talon extends outwardly and upwardly from the point of attachment to the shaft. Upon rotation of the shaft, the talon or talons mix, agitate or blend media into which the spindle is inserted.

DETAILED DESCRIPTION OF THE INVENTION

In general the invention provides a rotary shaft driven spindle. The spindle head comprises at least one large talon and one small talon each attached or to be attached for rotation to the shaft. Each talon includes a generally U-shaped element fixed for rotation to said shaft at the midpoint of the U. Each leg of the U defines an angle of from about 50° to 70° with the longitudinal axis of the shaft to which it is attached. Each leg of the U-shaped talon element has a linear extension which defines an angle of about 150° to about 175° with the leg it extends. The leg extensions terminate in tips which may extend inwardly toward or outwardly away from an attached shaft. Each tip defines an angle of about 20° to about 55° with the leg extension to which it is attached.

Figure 6:
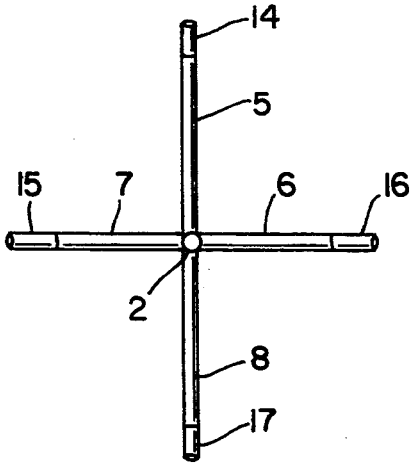
FIG. 6 is a plan view of the spindle head and shaft of FIG. 5. As FIG. 6 shows, the U-shaped talons intersect at 90° and are attached to the shaft 2 at the point of intersection.

Preferred embodiments of the invention include two talons, the U-shaped elements of which intersect at an angle of about 90° at the point of fixation of said talons to said shaft see FIG. 6.

In a preferred, relatively large embodiment of the invention, the legs of the U-shaped talon elements define an angle of from about 57° to about 69° with the longitudinal axis of said shaft, the linear extensions define an angle of from about 162° to about 174° with the associated leg of the U-shaped element and the tips define an angle of about 43° to about 55° with the corresponding leg extension.

In a preferred relatively small embodiment of the invention, the legs of the U-shaped talon elements define an angle of from about 50° to 62° with the longitudinal axis of said shaft, the linear extensions define an angle of from about 153° to about 165° with the associated leg of the U-shaped element and the tips define an angle of about 20° to about 32° with the corresponding leg extension.

Figure 8:
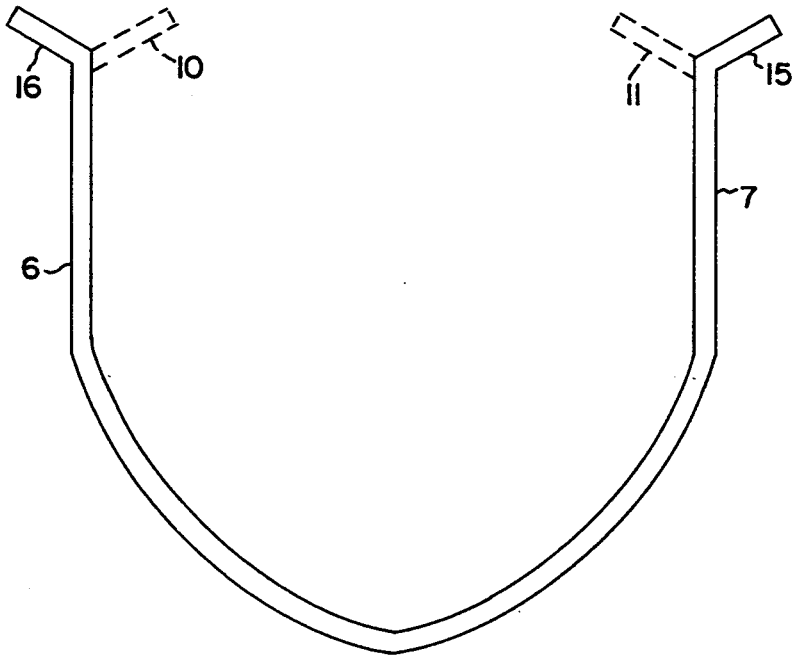
FIG. 8 is a side elevation view of a smaller talon for the spindle of FIG. 4 with a second embodiment shown in phantom.

In each of the preferred embodiments of the invention, and as illustrated by FIG. 8, each leg portion of each U-shaped element terminates at a point corresponding to a distance X from the point of fixation of the midpoint of said U to said shaft and in which the length of each linear extension of each leg of said U-shaped element is also X, the arrangement being such that each of said tip portions is positioned at a distance 2X from said point of fixation of the midpoint of said U to said shaft.

Figure 1:
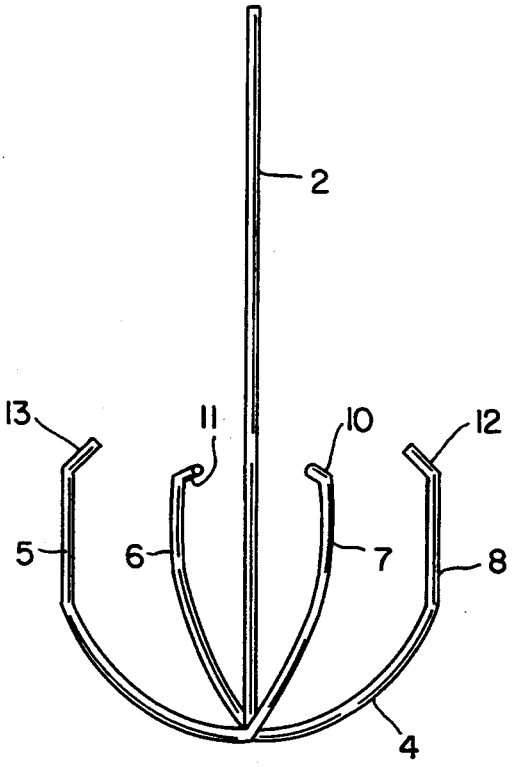
FIG. 1 is a perspective view of a two talon embodiment of a spindle head according to the present invention and of the associated rotary shaft.
Figure 2:
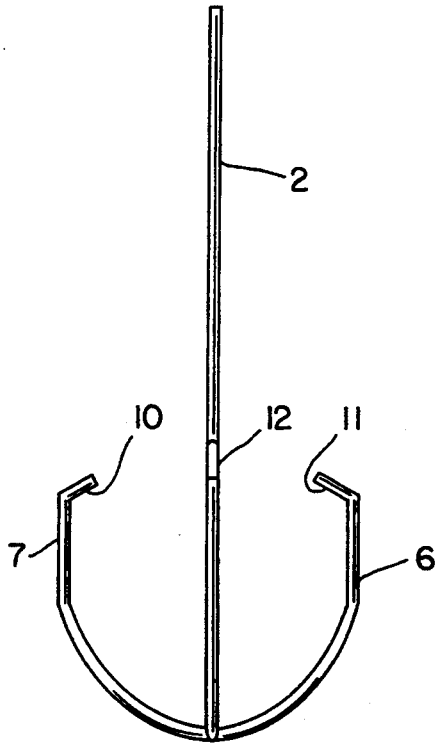
FIG. 2 is a side view of the spindle head and shaft of FIG. 1 taken perpendicular to the plane of the larger talon.
Figure 3:
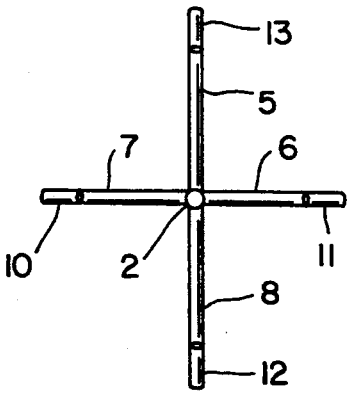
FIG. 3 is a plan view of the spindle head and shaft of FIG. 2.

Referring now to the FIGS. 1 to 3 which depict the preferred relatively large embodiment of the invention, the vertical shaft 2 is adapted at its upper end, by means not shown, to rotate with sufficient force and speed to accomplish the objective of mixing when a spindle of the type shown in the figures is attached.

The spindle head 4 is comprised of U-shaped talons. The larger talon consists of leg elements 5 and 8. The smaller talon consists of leg elements 6 and 7. The leg elements of the talons terminate in a tips 10, 11, 12 and 13 which, as shown, extend inwardly toward the shaft.

Figure 4:
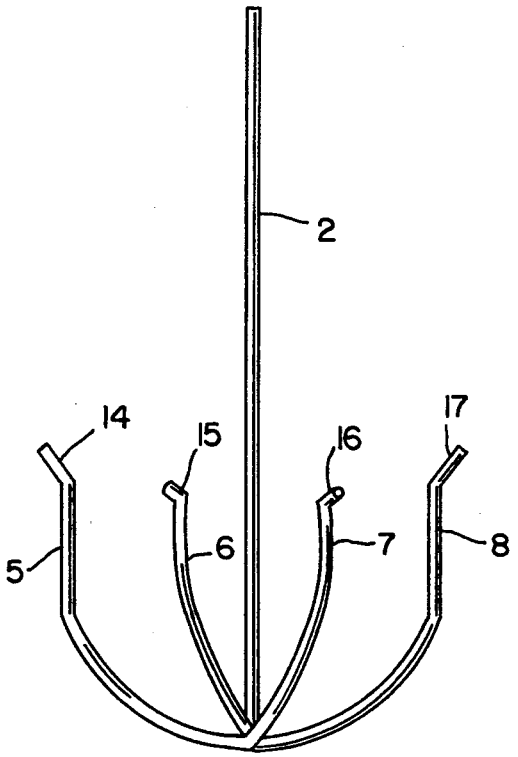
FIG. 4 is a perspective view of a smaller two talon embodiment of the spindle head and shaft of the present invention.
Figure 5:
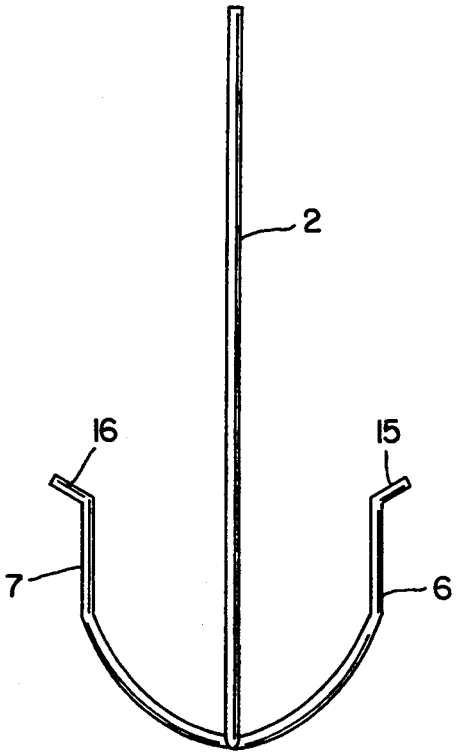
FIG. 5 is a side view of the spindle head and shaft of FIG. 4 taken perpendicular to the plane of a larger talon thereof.

FIGS. 4 to 6 depict a preferred form of a relatively smaller embodiment of the claimed spindle. FIGS. 4–6 include all of the same, similarly numbered elements 1 to 9. The inwardly extending tip elements 10, 11, 12 and 13 shown in FIGS. 1 to 3 are replaced in FIGS. 4 to 6 by tip elements 14, 15, 16 and 17 which extend outwardly or away from shaft 2.

Figure 7:
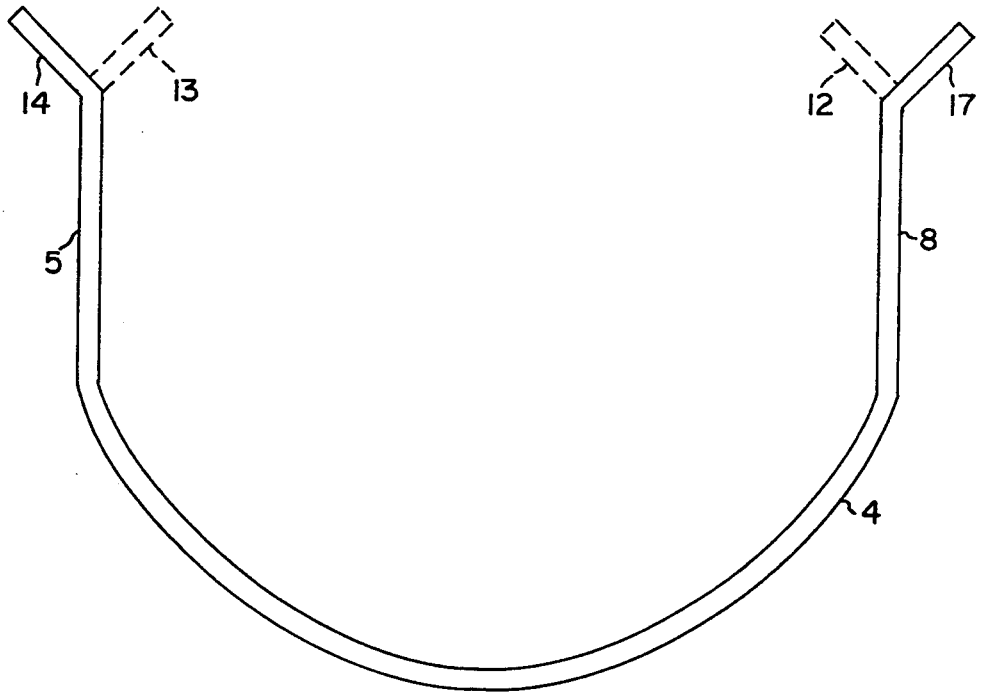
FIG. 7 is a side elevation view of a talon for the spindle of FIG. 1 with a second embodiment shown in phantom.

The angular and dimensional relationships for the preferred embodiment of spindle of the present invention are shown by FIG. 7 for the larger spindle and by FIG. 8 for the small spindle The spindle may be made of any suitable material of any suitable cross-section, and assembled in any conventional manner. In the preferred embodiments of the invention, the dimensional angular relationships facilitate achievement of the results sought over a wide variation in rotation speed and mixing vessel size. Such variables may be selected to achieve thorough blending or mixing in the shortest mixing time.

The invention has been described in detail with respect to its preferred embodiments. However, the scope of the invention is to be limited only by the scope of the appended claims interpreted in the light of the pertinent prior art.

I claim:

1. A mixing device comprising:

a rotatable shaft, said shaft having a longitudinal axis, an upper end for engagement with rotation means and a lower end, two mixing elements, each of said mixing elements having a generally U-shaped base portion, each of said U-shaped base portions of said two mixing elements having a midpoint where said base portions intersect at 90°, and where said mixing elements are attached to the lower end of said shaft, each of said generally U-shaped base portions of said two mixing elements having a linear element extending upwardly and parallel to the longitudinal axis of said shaft from each of the two legs of the U of said generally U-shaped base portions, each of said upwardly extending linear elements having a tip element, and each of said tip elements intersecting the associated linear element at an angle of 20° to 55°.

2. The mixing device of claim 1 in which the length of said U-shaped base portion as measured along said longitudinal axis of said shaft is equal to the length of each of said upwardly extending linear elements.

3. A mixing device as defined by claim 1 in which said tip elements extend inwardly towards said shaft.

4. A mixing device as defined by claim 1 in which said tip elements extend outwardly away from said shaft.

* * * * *